US007018581B2

(12) United States Patent
David et al.

(10) Patent No.: US 7,018,581 B2
(45) Date of Patent: Mar. 28, 2006

(54) METHOD OF FORMING A POLISHING PAD WITH REDUCED STRESS WINDOW

(75) Inventors: Kyle W. David, Newark, DE (US); Robert T. Gamble, Boothwyn, PA (US); Leslie A. Haschak, Wilmington, DE (US); George E. Lamborn, III, Wilmington, DE (US); Jason M. Lawhorn, Newark, DE (US); John V. H. Roberts, Newark, DE (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 86 days.

(21) Appl. No.: 10/865,121

(22) Filed: Jun. 10, 2004

(65) Prior Publication Data

US 2005/0275135 A1 Dec. 15, 2005

(51) Int. Cl.
*B29C 39/10* (2006.01)

(52) U.S. Cl. ..... 264/235; 264/275; 264/271.1; 264/279; 264/346

(58) Field of Classification Search ..... 264/235, 264/275, 271.1, 279, 346
See application file for complete search history.

(56) References Cited

U.S. PATENT DOCUMENTS

| | | | | |
|---|---|---|---|---|
| 5,605,760 | A | 2/1997 | Roberts | |
| 6,254,459 | B1 * | 7/2001 | Bajaj et al. | 451/41 |
| 6,623,331 | B1 | 9/2003 | Sevilla et al. | |
| 6,752,690 | B1 * | 6/2004 | Fruitman | 451/6 |
| 6,806,100 | B1 * | 10/2004 | Xu et al. | 438/8 |
| 2002/0173231 | A1 * | 11/2002 | Hasegawa | 451/6 |
| 2003/0207661 | A1 * | 11/2003 | Tregub et al. | 451/550 |
| 2004/0018809 | A1 | 1/2004 | Petroski et al. | |
| 2004/0068937 | A1 * | 4/2004 | Kamboi | 51/295 |
| 2004/0209066 | A1 * | 10/2004 | Swisher et al. | 428/313.5 |

* cited by examiner

*Primary Examiner*—Edmund H. Lee
(74) *Attorney, Agent, or Firm*—Edwin Oh

(57) ABSTRACT

The present invention provides a chemical mechanical polishing pad having reduced stress windows. In addition, the present invention provides a method of forming a chemical mechanical polishing pad, the method comprising, primary annealing a window separate from a polishing pad material and providing the polishing pad material in a periphery of the primary annealed window before a predetermined quench temperature of the primary annealed window. The method further comprises secondary annealing the window and the polishing pad material together and cutting the secondary annealed window and the polishing pad material to a predetermined thickness.

8 Claims, 3 Drawing Sheets

METHOD OF FORMING A POLISHING PAD WITH REDUCED STRESS WINDOW

BACKGROUND OF THE INVENTION

The present invention relates to polishing pads for chemical mechanical planarization (CMP), and in particular, relates to polishing pads having reduced stress windows formed therein for performing optical end-point detection.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer carrier is mounted on a carrier assembly and positioned in contact with a polishing pad in a CMP apparatus. The carrier assembly provides a controllable pressure to the wafer, pressing it against the polishing pad. The pad is optionally moved (e.g., rotated) relative to the wafer by an external driving force. Simultaneously therewith, a chemical composition ("slurry") or other polishing solution is provided between the wafer and the polishing pad. Thus, the wafer surface is thus polished and made planar by the chemical and mechanical action of the pad surface and slurry.

An important step in planarizing a wafer is determining an end-point to the process. Accordingly, a variety of planarization end-point detection methods have been developed, for example, methods involving optical in-situ measurements of the wafer surface. The optical technique involves providing the polishing pad with a window to select wavelengths of light. A light beam is directed through the window to the wafer surface, where it reflects and passes back through the window to a detector (e.g., a spectrophotometer). Based on the return signal, properties of the wafer surface (e.g., the thickness of films) can be determined for end-point detection.

Roberts, in U.S. Pat. No. 5,605,760, discloses a polishing pad having a window formed therein. In Roberts, a window is cast and inserted into a flowable polishing pad polymer. Unfortunately, as the flowable polymer sets, undue pressure or stress is applied to the window from the "contracting" polishing pad polymer and may cause unwanted residual stress deformations or "bulges" in the window. These stress deformations or bulges may result in non-planar windows and cause poor end-point detection.

Hence, what is needed is a polishing pad having a reduced stress window and method for manufacturing thereof, for robust end-point detection or measurement during CMP over a wide range of wavelengths.

STATEMENT OF THE INVENTION

In a first aspect of the present invention, there is provided a method of forming a chemical mechanical polishing pad, the method comprising: primary annealing a window separate from a polishing pad material; providing the polishing pad material in a periphery of the primary annealed window before a predetermined quench temperature of the primary annealed window; secondary annealing the window and the polishing pad material together; and cutting the secondary annealed window and the polishing pad material to a predetermined thickness.

In a second aspect of the present invention, there is provided a chemical mechanical polishing pad comprising: a polishing pad formed of a polishing pad material having a window for end-point detection formed therein, wherein the window is primary annealed separate from the polishing pad material and then secondary annealed with the polishing pad material.

DETAILED DESCRIPTION OF THE INVENTION

Figure 1:
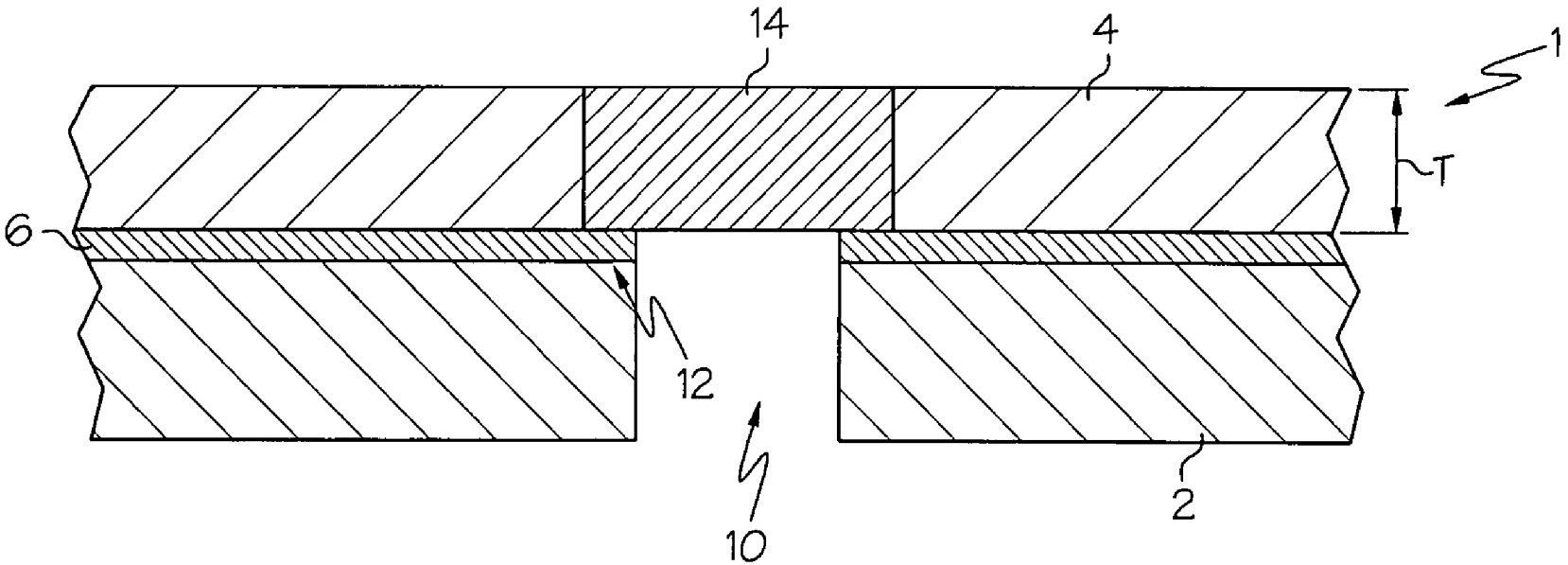
FIG. 1 illustrates a polishing pad having a window of the present invention.

Referring now to FIG. 1, a polishing pad 1 of the present invention is shown. Polishing pad 1 comprises a top pad 4 and an optional bottom pad 2. Note, top pad 4 and bottom pad 2 may individually serve as a polishing pad. In other words, the present invention may be utilized in the top pad 4 alone, or in the top pad 4 in conjunction with the bottom pad 2, as a polishing pad. The bottom pad 2 may be made of felted polyurethane, such as SUBA-IV™ manufactured by Rohm and Haas Electronic Materials CMP Inc. ("RHEM"), of Newark, Del. The top pad 4 may comprise a polyurethane pad (e.g., a pad filled with microspheres), such as, IC 1000™ by RHEM. A thin layer of pressure sensitive adhesive 6 may hold the top pad 4 and the bottom pad 2 together. Top pad 4 may have a thickness T between 1.25 to 2.50 mm.

In an exemplary embodiment, top pad 4 has a transparent window 14 provided over the bottom pad 2 and on the pressure sensitive adhesive 6. Note, window 14 is provided over the aperture 10 and shelf 12 to create a pathway for a signal light utilized during end-point detection. Accordingly, laser light from a laser spectrophotometer (not shown) may be directed through the aperture 10 and transparent window block 14, and onto a wafer or substrate to facilitate end-point detection.

Figure 2:
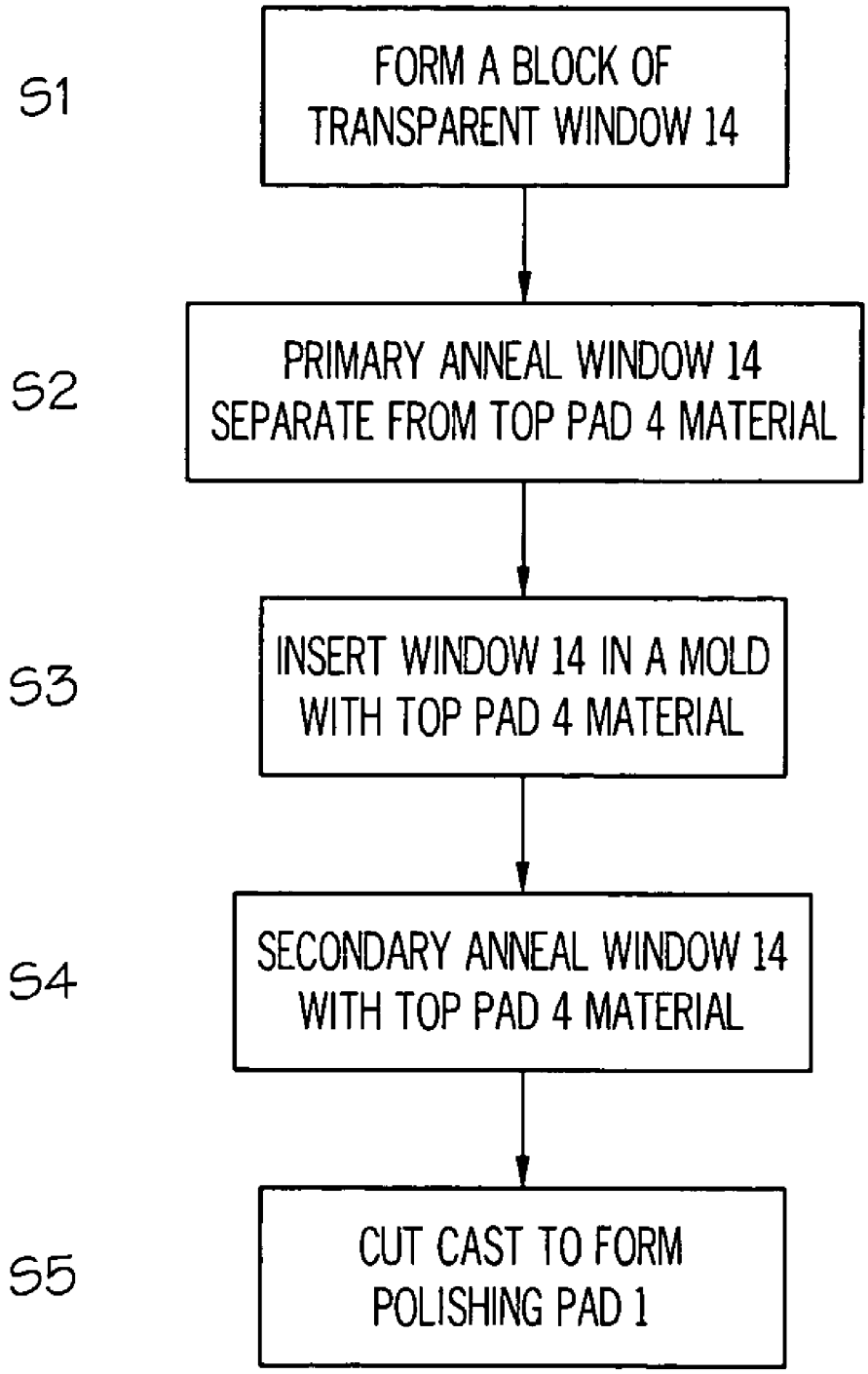
FIG. 2 illustrates an exemplary process of fabricating the polishing pad of FIG. 1.

Referring now to FIG. 2, in step S1, transparent window 14 is formed from a transparent material that is, for example, cast, sawed and machined into a block. The block may be in the form of a rod or a plug. Other methods, for example, extrusion may be utilized to form window 14. Thereafter, in step S2, the block of window 14 is annealed at a predetermined temperature to uniformly relieve any residual stress. In other words, window 14 may be free to expand and contract without any undue stress or impediment by the top pad 4 material, as further discussed below. Thus, window 14 is subjected to a primary annealing process and uniformly subjected to heat to evenly expand and contract the window 14 (along with the top pad material 4) and to distribute any stress at different areas, especially, at the adjoining periphery of the window 14 and the top pad material 4.

Advantageously, the window 14 is primary annealed at a temperature between 25° C. to 165° C. for 30 minutes to 24 hours. Preferably, the window 14 is primary annealed at a temperature between 30° C. to 150° C. for 1 hour to 15 hours. Most preferably, the window 14 is primary annealed at a temperature between 40° C. to 120° C. for 1.25 hours to 13 hours.

Next, in step S3, the primary annealed window 14 is inserted in, for example, a mold and then the top pad 4 material, in a flowable state, is provided around window 14, including an adjoining periphery thereof. Next, in step S4, the flowable top pad 4 material and the window 14 are annealed together to form a casting. In other words, the window 14 is subjected to a secondary annealing process together with the top pad 4 material.

Advantageously, in step S3, the primary annealed window 14 is inserted in the mold before a predetermined quench temperature. In particular, the window 14 is inserted in the mold before the window 14 is 15° C. less than the temperature at which the window 14 was annealed. In other words, the temperature of the window 14 does not change more than 15° C. from the time the window 14 is primary annealed to the time the window is inserted into the mold. Preferably, the window 14 is inserted in the mold before the window 14 is 10° C. less than the temperature at which the window 14 was annealed. Most preferably, the window 14 is inserted in the mold before the window 14 is 5° C. less than the temperature at which the window 14 was annealed.

Next, in step S5, sheets of top pad 4 having a window 14 may be formed by, for example, skiving the cast. Hence, the window 14 is subjected to a primary annealing process, separate from the top pad 4 material, to relieve any residual stress and then subjected to a secondary annealing process with the top pad 4 material to form the polishing pad. As defined herein, "separate" means at least two distinct and individual processes or steps. In this way, the window 14 is allowed to "expand" freely without undue stress and then allowed to "retract" along with the top pad 4 material to reduce stress. In other words, by subjecting the window 14 to the primary anneal, the window 14 is less susceptible to the pressures or stress caused by the cooling and contracting of the polishing pad material, as compared to when the window 14 is not subjected to a primary annealing process. Rather, the primary annealed window 14 and the polishing pad material can be secondarily annealed together, thereby reducing stress or "bulges" and resulting in windows with improved end-point detection capability. The window 14 of the present invention is capable of being utilized for light transmissions having a wavelength between 350 to 900 nm.

Accordingly, the present invention provides a chemical mechanical polishing pad having reduced stress windows. In addition, the present invention provides a method of forming a chemical mechanical polishing pad, the method comprising, primary annealing a window separate from a polishing pad material and providing the polishing pad material in a periphery of the primary annealed window before a predetermined quench temperature of the primary annealed window. The method further comprises secondary annealing the window and the polishing pad material together and cutting the secondary annealed window and the polishing pad material to a predetermined thickness.

Additionally, in an exemplary embodiment of the present invention, the transparent material of window 14 is made from a polyisocyanate-containing material ("prepolymer"). The prepolymer is a reaction product of a polyisocyanate (e.g., diisocyanate) and a hydroxyl-containing material. The polyisocyanate may be aliphatic or aromatic. The prepolymer is then cured with a curing agent. Preferred polyisocyanates include, but are not limited to, methlene bis 4,4' cyclohexylisocyanate, cyclohexyl diisocyanate, isophorone diisocyanate, hexamethylene diisocyanate, propylene-1,2-diisocyanate, tetramethylene-1,4-diisocyanate, 1,6-hexamethylene-diisocyanate, dodecane-1,12-diisocyanate, cyclobutane-1,3-diisocyanate, cyclohexane-1,3-diisocyanate, cyclohexane-1,4-diisocyanate, 1-isocyanato-3,3,5-trimethyl-5-isocyanatomethylcyclohexane, methyl cyclohexylene diisocyanate, triisocyanate of hexamethylene diisocyanate, triisocyanate of 2,4,4-trimethyl-1,6-hexane diisocyanate, uretdione of hexamethylene diisocyanate, ethylene diisocyanate, 2,2,4-trimethylhexamethylene diisocyanate, 2,4,4-trimethylhexamethylene diisocyanate, dicyclohexylmethane diisocyanate, and mixtures thereof. The preferred polyisocyanate is aliphatic. The preferred aliphatic polyisocyanate has less than 14% unreacted isocyanate groups.

Advantageously, the hydroxyl-containing material is a polyol. Exemplary polyols include, but are not limited to, polyether polyols, hydroxy-terminated polybutadiene (including partially/fully hydrogenated derivatives), polyester polyols, polycaprolactone polyols, polycarbonate polyols, and mixtures thereof.

In one preferred embodiment, the polyol includes polyether polyol. Examples include, but are not limited to, polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol, polybutylene adipate glycol, polyethylene propylene adipate glycol, o-phthalate-1,6-hexanediol, poly(hexamethylene adipate) glycol, and mixtures thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, PTMEG-initiated polycaprolactone, and mixtures thereof. The hydrocarbon chain can have saturated or unsaturated bonds, or substituted or unsubstituted aromatic and cyclic groups. Suitable polycarbonates include, but are not limited to, polyphthalate carbonate and poly(hexamethylene carbonate) glycol.

Advantageously, the curing agent is a polydiamine. Preferred polydiamines include, but are not limited to, diethyl toluene diamine ("DETDA"), 3,5-dimethylthio-2,4-toluenediamine and isomers thereof, 3,5-diethyltoluene-2,4-diamine and isomers thereof, such as 3,5-diethyltoluene-2,6-diamine, 4,4'-bis-(sec-butylamino)-diphenylmethane, 1,4-bis-(sec-butylamino)-benzene, 4,4'-methylene-bis-(2-chloroaniline), 4,4'-methylene-bis-(3-chloro-2,6-diethylaniline) ("MCDEA"), polytetramethyleneoxide-di-p-aminobenzoate, N,N'-dialkyldiamino diphenyl methane, p,p'-methylene dianiline ("MDA"), m-phenylenediamine ("MPDA"), methylene-bis 2-chloroaniline ("MBOCA"), 4,4'-methylene-bis-(2-chloroaniline) ("MOCA"), 4,4'-methylene-bis-(2,6-diethylaniline) ("MDEA"), 4,4'-methylene-bis-(2,3-dichloroaniline) ("MDCA"), 4,4'-diamino-3,3'-diethyl-5,5'-dimethyl diphenylmethane, 2,2',3,3'-tetrachloro diamino diphenylmethane, trimethylene glycol di-p-aminobenzoate, and mixtures thereof. Preferably, the curing agent of the present invention includes 3,5-dimethylthio-2,4-toluenediamine and isomers thereof. Suitable polyamine curatives include both primary and secondary amines.

In addition, other curatives such as, a diol, triol, tetraol, or hydroxy-terminated curative may be added to the aforementioned polyurethane composition. Suitable diol, triol, and tetraol groups include ethylene glycol, diethylene glycol, polyethylene glycol, propylene glycol, polypropylene glycol, lower molecular weight polytetramethylene ether glycol, 1,3-bis(2-hydroxyethoxy) benzene, 1,3-bis-[2-(2-hydroxyethoxy) ethoxy]benzene, 1,3-bis-{2-[2-(2-hydroxyethoxy) ethoxy]ethoxy}benzene, 1,4-butanediol, 1,5-pentanediol, 1,6-hexanediol, resorcinol-di-(beta-hydroxyethyl) ether, hydroquinone-di-(beta-hydroxyethyl) ether, and mixtures thereof. Preferred hydroxy-terminated curatives include 1,3-bis(2-hydroxyethoxy) benzene, 1,3-bis-[2-(2-hydroxyethoxy) ethoxy]benzene, 1,3-bis-{2-[2-(2-hydroxyethoxy) ethoxy]ethoxy}benzene, 1,4-butanediol, and mixtures thereof. Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the invention, window 14 may be formed of, for example, polyurethanes, both thermoset and thermoplastic, polycarbonates, polyesters, silicones, polyimides and polysulfone. Example materials for window 14 include, but are not limited to, polyvinyl chloride, polyacrylonitrile, polymethylmethacrylate, polyvinylidene fluoride, polyethylene terephthalate, polyetheretherketone, polyetherketone, polyetherimide, ethylvinyl acetate, polyvinyl butyrate, polyvinyl acetate, acrylonitrile butadiene styrene, fluorinated ethylene propylene and perfluoralkoxy polymers.

Figure 3:
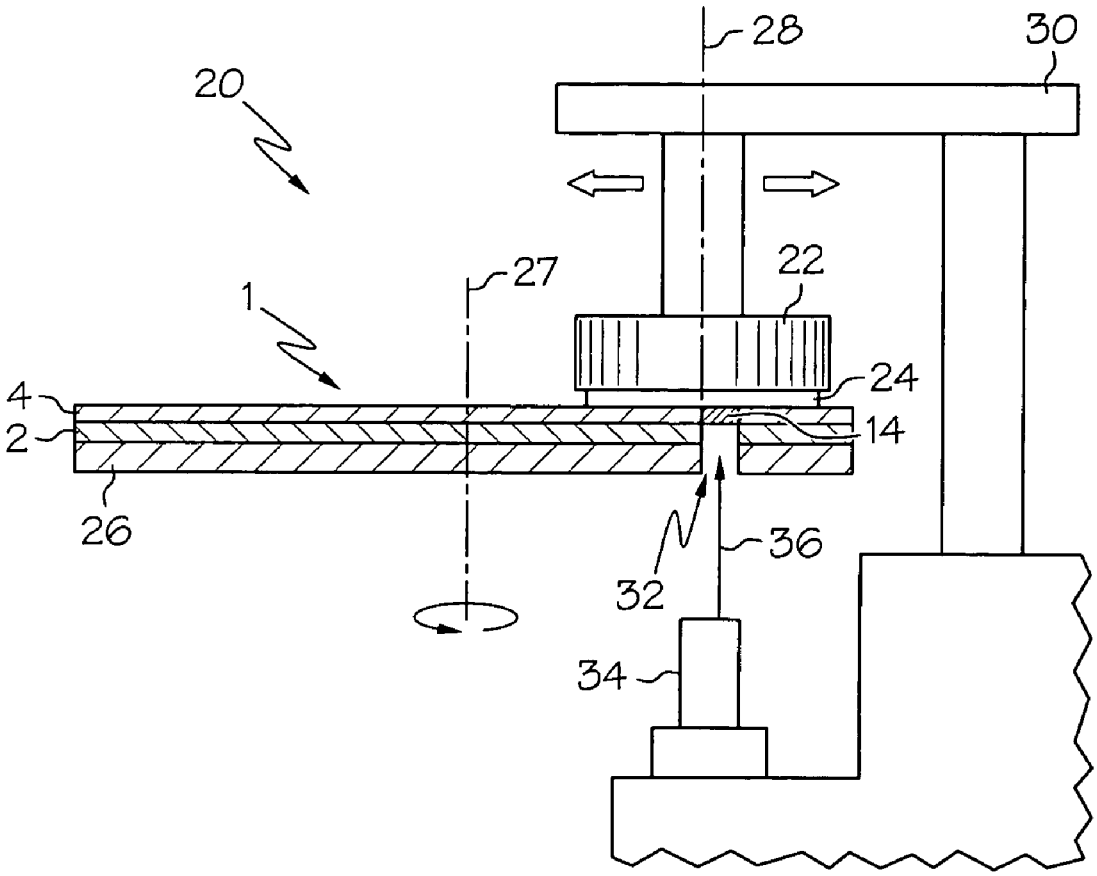
FIG. 3 illustrates a CMP system utilizing the polishing pad of the present invention.

Referring now to FIG. 3, a CMP apparatus 20 utilizing the polishing pad of the present invention is provided. Apparatus 20 includes a wafer carrier 22 for holding or pressing the semiconductor wafer 24 against the polishing platen 26. The polishing platen 26 is provided with pad 1, including window 14, of the present invention. As discussed above, pad 1 has a bottom layer 2 that interfaces with the surface of the platen, and a top layer 4 that is used in conjunction with a chemical polishing slurry to polish the wafer 24. Note, although not pictured, any means for providing a polishing fluid or slurry can be utilized with the present apparatus. The platen 26 is usually rotated about its central axis 27. In addition, the wafer carrier 22 is usually rotated about its central axis 28, and translated across the surface of the platen 26 via a translation arm 30. Note, although a single wafer carrier is shown in FIG. 5, CMP apparatuses may have more than one spaced circumferentially around the polishing platen. In addition, a hole 32 is provided in the platen 26 and overlies the window 14 of pad 1. Accordingly, hole 32 provides access to the surface of the wafer 24, via window 14, during polishing of the wafer 24 for accurate end-point detection. Namely, a laser spectrophotometer 34 is provided below the platen 26 which projects a laser beam 36 to pass and return through the hole 32 and high transmission window 14 for accurate end-point detection during polishing of the wafer 24.

Accordingly, the present invention provides a chemical mechanical polishing pad having reduced stress windows. In addition, the present invention provides a method of forming a chemical mechanical polishing pad, the method comprising, primary annealing a window separate from a polishing pad material and providing the polishing pad material in a periphery of the primary annealed window before a predetermined quench temperature of the primary annealed window. The method further comprises secondary annealing the window and the polishing pad material together and cutting the secondary annealed window and the polishing pad material to a predetermined thickness. In addition, the method may further comprise providing a stress relief zone in an adjoining periphery of the window. The window of the present invention shows unexpected, improved transmission of laser signals for end-point detection during chemical mechanical polishing.

What is claimed is:

1. A method of forming a chemical mechanical polishing pad, the method comprising:

primary annealing a window separate from a polishing pad material;

providing the polishing pad material in a periphery of the primary annealed window before the temperature of the primary annealed window is less than a predetermined quench temperature;

secondary annealing the primary annealed window and the polishing pad material together; and cutting the secondary annealed window and the polishing pad material to a predetermined thickness.

2. The method of claim 1 wherein the window is primary annealed between 25° C. to 165° C. for up to 24 hours.

3. The method of claim 2 wherein the window is primary annealed between 30° C. to 150° C. for 1 hour to 15 hours.

4. The method of claim 3 wherein the window is primary annealed between 40° C. to 120° C. for 1.25 hours to 13 hours.

5. The method of claim 1 wherein the quench temperature of the window is 15° C. less than the temperature of the primary anneal.

6. The method of claim 5 wherein the quench temperature of the window is 10° C. less than the temperature of the primary anneal.

7. The method of claim 6 wherein the quench temperature of the window is 5° C. less than the temperature of the primary anneal.

8. The method of claim 1 wherein the window is formed from a material selected from the group comprising of polyvinyl chloride, polyacrylonitrile, polymethylmethacrylate, polyvinylidene fluoride, polyethylene terephthalate, polyetheretherketone, polyetherketone, polyetherimide, ethylvinyl acetate, polyvinyl butyrate, polyvinyl acetate, acrylonitrile butadiene styrene, fluorinated ethylene propylene and perfluoralkoxy polymers.

* * * * *